US007786679B2

(12) United States Patent
Rudolph

(10) Patent No.: US 7,786,679 B2
(45) Date of Patent: Aug. 31, 2010

(54) ELECTRONIC BALLAST FOR DISCHARGE LAMPS HAVING AN EOL MONITORING CIRCUIT

(75) Inventor: Bernd Rudolph, Forstern (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 450 days.

(21) Appl. No.: 11/989,721

(22) PCT Filed: Aug. 28, 2006

(86) PCT No.: PCT/EP2006/065741

§ 371 (c)(1),
(2), (4) Date: Jan. 30, 2008

(87) PCT Pub. No.: WO2007/025953

PCT Pub. Date: Mar. 8, 2007

(65) Prior Publication Data

US 2009/0085493 A1 Apr. 2, 2009

(30) Foreign Application Priority Data

Aug. 30, 2005 (DE) ..... 20 2005 013 675 U

(51) Int. Cl.
*H05B 37/02* (2006.01)

(52) U.S. Cl. ..... 315/224; 315/307; 315/308; 315/DIG. 5

(58) Field of Classification Search ..... 315/246, 315/247, 291, 224, 307, 308, DIG. 4, DIG. 5, 315/DIG. 7
See application file for complete search history.

(56) References Cited

U.S. PATENT DOCUMENTS

| | | | | |
|---|---|---|---|---|
| 6,288,500 | B1 * | 9/2001 | Klier | 315/209 R |
| 7,064,499 | B2 * | 6/2006 | Lott | 315/291 |
| 2003/0168997 | A1 * | 9/2003 | Nishimoto et al. | 315/291 |

FOREIGN PATENT DOCUMENTS

| | | |
|---|---|---|
| EP | 1 492 393 A1 | 12/2004 |
| WO | 00/11916 | 3/2000 |

* cited by examiner

*Primary Examiner*—David Hung Vu

(57) ABSTRACT

The invention relates to an electronic ballast for a discharge lamp LA1 having an EOL monitoring circuit R1, R2, U1, R9, U2-A, U2-B, U3-A, AE, which has a current differential amplifier U1 having a current mirror input.

20 Claims, 3 Drawing Sheets

ELECTRONIC BALLAST FOR DISCHARGE LAMPS HAVING AN EOL MONITORING CIRCUIT

TECHNICAL FIELD

The invention is based on AC operation of discharge lamps using electronic ballasts.

PRIOR ART

Discharge lamps of various designs are nowadays usually operated using electronic ballasts. Such ballasts generally contain high-frequency converters for generating an AC supply power for the lamp from a low-frequency system supply or else from a DC voltage supply.

In addition to the essential functions for starting and operating the discharge lamp, electronic ballasts often also have additional monitoring and regulation functions. In the present context, so-called EOL monitoring (end of life monitoring) is of interest, in which a circuit element of the ballast is used to monitor when an end of life of one of the electrodes of the discharge lamp operated is indicated.

Such EOL monitoring circuits are known per se, for example from WO 00/11916, to which reference is made, by way of summary, for explaining the technical background. In particular, this document explains the fact that the rectifying properties of the discharge lamp which are established as the end of life of the electrode approaches are utilized for EOL monitoring. The end of life of the electrode entails consumption or degradation of an electron emitter material. In more general terms, the end of life of an electrode is indicated by a rise in the electron work function at this electrode. This results in asymmetry during AC operation or, in other words, a unipolar additional power in the lamp having a corresponding asymmetrical voltage drop.

DESCRIPTION OF THE INVENTION

The object of the present invention is to specify an electronic ballast for discharge lamps which is improved as regards EOL monitoring.

The invention firstly relates to an electronic ballast for AC operation of a discharge lamp having an EOL monitoring circuit for detecting the end of life of the electrodes of the discharge lamp, which EOL monitoring circuit responds to an asymmetrical power of the discharge lamp, characterized in that a current associated with the asymmetrical power and a reference current are fed to a current differential amplifier in the EOL monitoring circuit, to a corresponding lamp system comprising such a ballast together with an appropriate discharge lamp.

Preferred refinements are specified in the dependent claims and will be explained in more detail below.

The basic concept of the invention consists in, as a deviation from the prior art, not deriving a voltage correlating with the beginning rectifying properties of the discharge lamp, detecting it via a voltage-sensitive amplifier circuit and using it for controlling the operation of the ballast, but instead carrying out current differential amplification. For this purpose, a current correlating with the asymmetrical power of the discharge lamp is used and fed, together with a reference current, to a current differential amplifier. The current differential amplifier is characterized by the fact that it permits input currents, even when an EOL is not detected, i.e. no rectifying properties can yet be detected. It is therefore possible, in particular, to avoid a situation in which voltage displacements result in the case of voltage-sensitive inputs with transistors, which are connected in the case of an EOL detection, as a result of the then occurring current load on resistors, with which corresponding measured voltages for detection purposes or reference voltages for comparison purposes are generated.

In particular in WO 00/11916 mentioned above, two voltage divider circuits subject one another to a load since a current is formed from a voltage differential signal, which current represents the further signal variable. This results in a parasitic voltage displacement, a dependence on the absolute values of the potentials used with respect to the reference potential and nonlinear dependencies on the potential differences.

In contrast to this, current inputs are used in the invention which may also carry currents in the normal operating case, with the result that no substantial displacements result in the case of an EOL detection.

Owing to resistors in the power supply lines having a correspondingly high resistance value, the measured current required and the reference current can be reduced to such small values that the associated power consumption is completely insignificant. In addition, suitable working points can easily be set owing to corresponding initial loads, for example owing to feedback at the current differential amplifier.

One preferred refinement of the input of the current differential amplifier consists in a current mirror circuit known per se, the current differential amplifier moreover particularly preferably being in the form of an operational amplifier. Such OP amplifiers with a mirror input are obtainable, for example, as so-called Norton amplifiers by Motorola, nowadays "On Semiconductors".

This Norton amplifier also has a voltage output and therefore has a further preferred feature of the invention. Finally, the amplifier is one which has a MOSFET current mirror input, a favorable embodiment of such a current mirror input. Moreover, current mirror inputs may, however, also be designed using other unipolar technology or else using bipolar technology.

In one simple and favorable refinement of the invention, an output signal from the current differential amplifier can be passed on to a window comparator, i.e. a combination of two simple comparators, whose threshold values provide a corresponding window. The output signals of the comparators can be linked, for example, via a NAND gate and fed to a shutdown device, which takes the high-frequency converter out of operation in the event of the end of life of an electrode being detected.

Since parasitic oscillations and harmonics may result in the ballast during operation, in particular transient responses are possible at the beginning of operation, the EOL monitoring circuit preferably has a low-pass filter, for example an RC element. In one favorable refinement, the capacitor of the RC element may be positioned between the measured current input of the current differential amplifier and the ballast-internal reference potential.

Instead of an evaluation using comparators and logic gates, which is particularly suitable for discrete implementations, microprocessor sampling of the current differential amplifier may also be provided, which samples at specific time intervals and possibly carries out repeat interrogations in the case of an EOL detection for safety reasons. In this case, note should be made of the fact that the response times prescribed by standards and/or the technical boundary conditions for EOL monitoring circuits are not particularly short, but a few seconds time is generally available. Finally, it is generally only critical to avoid thermal damage and, for example, resultant fire hazards owing to electrodes returning to the asymmetrical additional power in the lamp. These thermal processes are comparatively slow.

One possibility for generating a reference current for the current differential amplifier consists in deriving a current from a reference potential via a resistor having a relatively high resistance value, in particular by the ballast-internal high-frequency converter.

In many cases which are important in practical terms, a so-called coupling capacitor is present between the discharge lamp and the ballast-internal reference potential, which coupling capacitor is generally charged to a mid-potential between the ballast-internal supply potential and the reference potential during operation and therefore ensures true AC operation of the discharge lamp. With this circuitry, the current differential amplifier, which moreover has a reference to this reference potential, can favorably be connected to a tap between the coupling capacitor and the discharge lamp via resistors in order to therefore tap off a current correlating with the voltage across the coupling capacitor. In this case, it is necessary to take into account the fact that the inputs of the current differential amplifier are very close to the reference potential in terms of their potential.

Other circuitry which is important in practical terms provides a corresponding coupling capacitor between the AC output of the high-frequency converter and the discharge lamp and correspondingly then generally connects the other terminal of the discharge lamp directly to the reference potential. Owing to the fact that resonant capacitors, which are required in particular for resonant starting processes, are connected in parallel with the lamp, such circuits may be particularly advantageous for being able to measure the lamp current in a simple and direct manner and to use it, for example, for current regulation purposes. In this case, it is favorable to derive the measured current for the current differential amplifier, which in turn has a reference to the reference potential, in turn from a center tap between the coupling capacitor and the discharge lamp via a resistor. This measured current then correlates with the lamp voltage, i.e. would have an average value of zero during true AC operation in a smoothed manner. In this case, the corresponding measured current input of the current differential amplifier may be subjected to an initial load, for example, via feedback from the amplifier output, for which purpose reference is also made to the second exemplary embodiment.

One preferred application of the invention is in low-pressure discharge lamps, but it is also suitable for high-pressure discharge lamps.

In addition, the invention has a method aspect and correspondingly also relates to a method for AC operation of a discharge lamp using such a ballast, in which method the end of life of an electrode of the discharge lamp is detected by an EOL monitoring circuit, which responds to an asymmetrical power of the discharge lamp, characterized in that a current associated with the asymmetrical power and a reference current are fed to a current differential amplifier in the EOL monitoring circuit. The individual features explained above and below are also implicitly critical to the method aspect of the invention.

BRIEF DESCRIPTION OF THE DRAWINGS

The invention will be explained in more detail below with reference to exemplary embodiments, it being possible for the individual features also to be essential to the invention in other combinations, and these individual features relating both to the apparatus aspect and to the method aspect of the invention.

PREFERRED EMBODIMENT OF THE INVENTION

Figure 1:
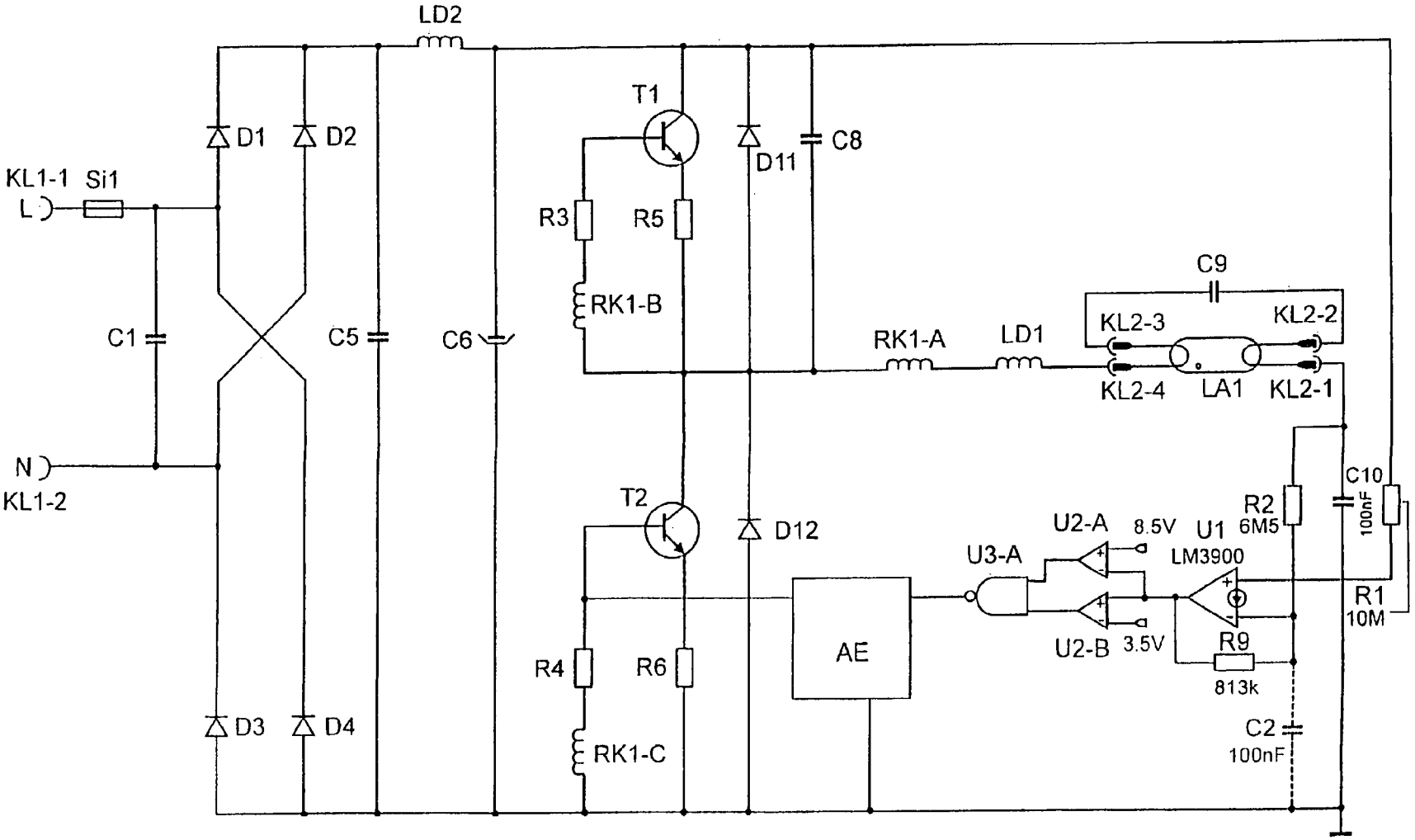
FIG. 1 shows a simplified circuit diagram of a ballast for a low-pressure discharge lamp as a first exemplary embodiment.

FIG. 1 shows a circuit diagram of a ballast according to the invention for a low-pressure discharge lamp LA1, which is likewise illustrated in the right-hand region and is connected in the left-hand region to the input terminals KL1-1 and KL1-2 for a customary domestic power supply by a phase line L and a neutral line N. The inductor LD2 and the capacitor C5 form a radio interference suppression filter between the rectifier D1 to D4 and an intermediate circuit storage capacitor C6, across which the intermediate circuit voltage is present with a ballast-internal reference potential, in the lower region of the figure, and a ballast-internal supply potential, in the upper region.

Two switching transistors T1 and T2 of a conventional half-bridge converter circuit are connected between these two potentials, in each case freewheeling diodes D11 and D12 being connected in parallel with said two switching transistors T1 and T2, and said switching transistors T1 and T2 having switching load relief owing to a so-called trapezoidal capacitor C8 between their center tap and the supply potential. The control terminals, in this case the bases of the bipolar transistors T1 and T2, are driven via secondary windings RK1-B and RK1-C and resistors R3 and R4, respectively, a primary winding RK1-A being coupled to the secondary windings RK1-B and RK1-C and being positioned between the mentioned center tap and therefore the AC output of the half bridge and the lamp LA1. A conventional lamp inductor LD1 is positioned between the primary winding of the control transformer, which is formed from the windings RK1-A, RK1-B and RK1-C and is moreover in this case only symbolic of a self-excited drive circuit, which can also be realized differently, in particular by means of an external controller, and the lamp LA1. The lamp LA1 is connected via lamp terminals KL2-1 to KL2-4, the terminals KL2-3 and KL2-4 being provided on the center-tap side, and the terminals KL2-1 and KL2-2 being provided on the other side of the lamp, and a resonant capacitor C9, which is required in a manner known per se for starting the lamp, is connected between the terminals KL2-2 and KL2-3.

The lamp terminal KL2-1 is connected to the reference potential via a coupling capacitor C10 which is likewise known per se, with the result that, during operation, the coupling capacitor C10 is charged on average to half the intermediate circuit voltage via the intermediate circuit capacitor C6, and the lamp LA1 can therefore be operated in a true AC operating mode as a result of the center-tap potential which oscillates symmetrically about the potential prevailing at the upper terminal of the coupling capacitor C10.

That part of the circuit which has been described up until now is conventional per se and is therefore not explained in detail. The EOL monitoring circuit according to the invention will be explained below. This EOL monitoring circuit has an OP amplifier U1 having a current mirror input, in this case a so-called Norton amplifier LM3900 by On Semiconductors.

A reference current, which is derived from the supply potential via a resistor having a high resistance value of 10 MO is passed on to the noninverting input (denoted by "+") of said Norton amplifier, and a measured current, which is derived from a tap between the coupling capacitor C10 and the lamp terminal KL2-1 via a resistor R2 likewise having a high resistance value of 6.5 MO, is passed on to the inverting input (denoted by "−"). The difference between the two is amplified in a manner known per se, the amplifier U1 being connected with feedback in a manner known per se between its output and its inverting input via a resistor R9 having a high resistance value of 813 kO.

The output signal from the amplifier U1 is passed on to a window comparator comprising a first comparator U2-A and a second comparator U2-B, in which window comparator it is compared with a threshold value window, in this case between 3.5 V and 8.5 V. Correspondingly, the inputs of the comparators U2-A and U2-B are connected to a NAND gate U3-A, whose output therefore indicates whether the current difference lies within the tolerance range defined by the two comparator threshold values or not.

This signal is fed to a shutdown device AE, which suppresses driving of the base of the lower switching transistor T2 of the half-bridge converter in response to this signal, as a result of which the switching operations of the upper switching transistor T1 are also suppressed.

It has already been established that true AC operation results in the case of a lamp LA1 having electrodes on both sides which are fully capable of emission and a potential, which corresponds to the DC component of the potential at the AC output of the half bridge of the switching transistors T1 and T2, is established across the capacitor C10. This potential, if required, can be smoothed via the additional capacitor C2 having a capacitance of 100 nF between the inverting input of the amplifier U1 and the reference potential.

Even in the case of different conditions, for example in the case of a duty factor for the switching transistor operation which is different than 0.5, a specific average voltage results at the coupling capacitor C10.

Since the amplifier U1 has a reference to the reference potential and, as a result of its current mirror input, builds up only low voltages at its inputs in comparison with the reference potential (generally below 1 volt), the current flowing through the resistor R2 in the inverting input of the amplifier U1 corresponds practically proportionally to the voltage across the coupling capacitor C10. The current flowing in the inverting input consists of this current and the current through the feedback capacitor R9. In this case, the resistors R2 and R9 are dimensioned such that, in the case of equilibrium without any asymmetrical EOL voltage component at the coupling capacitor C10, the output of the amplifier U1 is approximately half of the arithmetic mean of the reference potentials at the inputs of the window comparator U2-A, U2-B of 6 V. In the present case, shutdown potentials of approximately +/−20 V result at the coupling capacitor C10.

Figure 2:
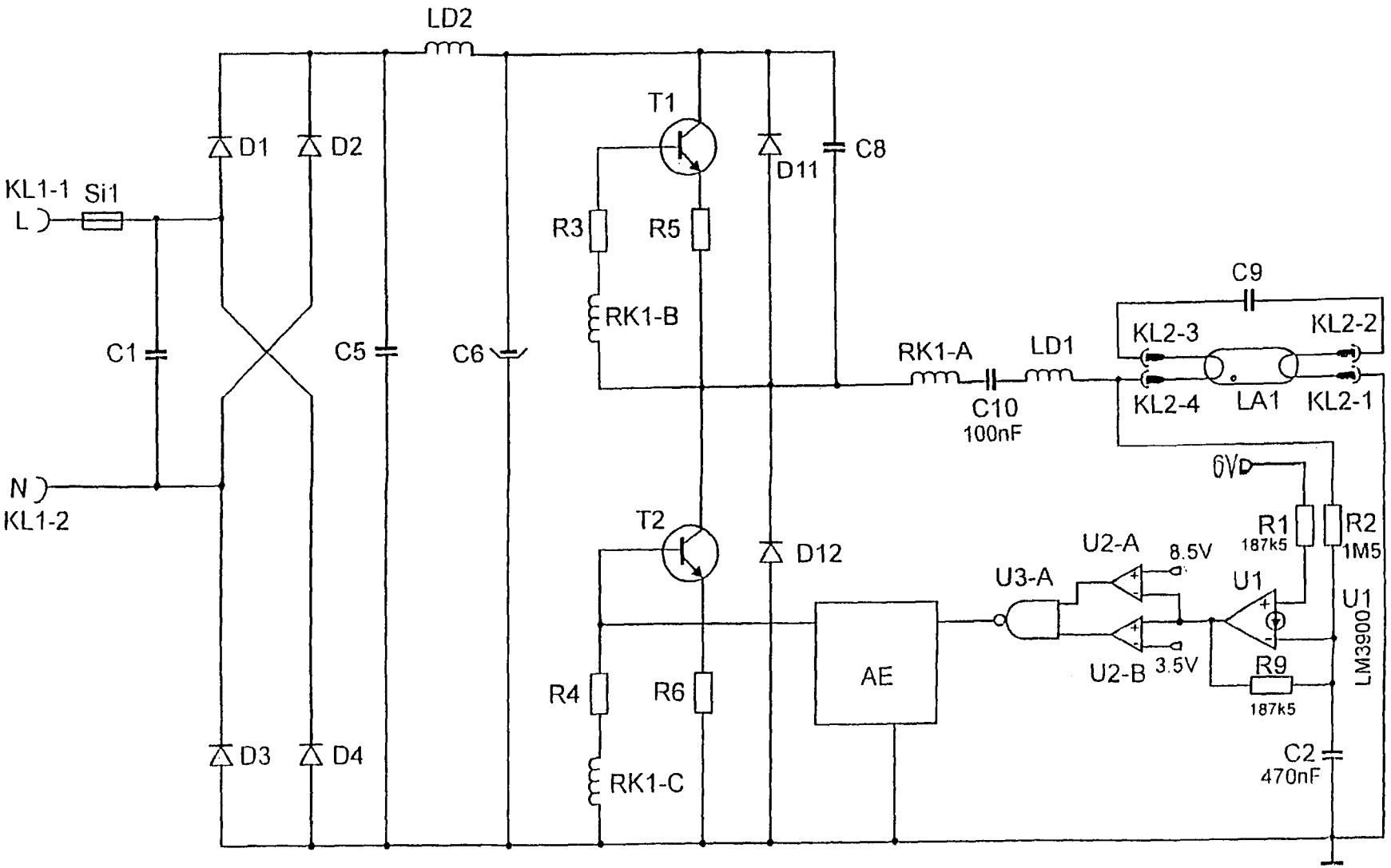
FIG. 2 corresponds to FIG. 1 and shows a second exemplary embodiment.

FIG. 2 shows an exemplary embodiment which is largely identical to FIG. 1, but with different circuitry for the coupling capacitor C10 and therefore also a slightly different connection of the amplifier U1. Reference is therefore first made to the explanations relating to FIG. 1. As a deviation from this, the coupling capacitor C10 is in this case positioned between the primary winding RK1-A and the lamp inductor LD1 and therefore between the AC output of the half-bridge converter and the switching transistors T1 and T2 of the lamp LA1, however.

Consequently, the measured current is taken from a tap between the lamp inductor LD1 and the lamp LA1 via the resistor R2, which is in this case given a value of 1.5 MO. Since the DC voltage component across the resistor R2 is considerably smaller than in the case of the first exemplary embodiment, the reference potential for the reference current, in this case at 6 V, is drawn from a supply which is in any case available to control circuits of the ballast, and the corresponding resistor R1 is matched. In this exemplary embodiment, the capacitor C2 illustrated as optional (and therefore with dashed lines) in FIG. 1 needs to be provided for the low-pass smoothing.

During symmetrical normal operation, it therefore results that the quiescent current in the inverting input flows completely through the feedback capacitor R9 and is therefore equal to the current through the resistor R1. The voltage across R1 therefore corresponds to the arithmetic mean between the two threshold values of the window comparator U2-A, U2-B.

Figure 3:
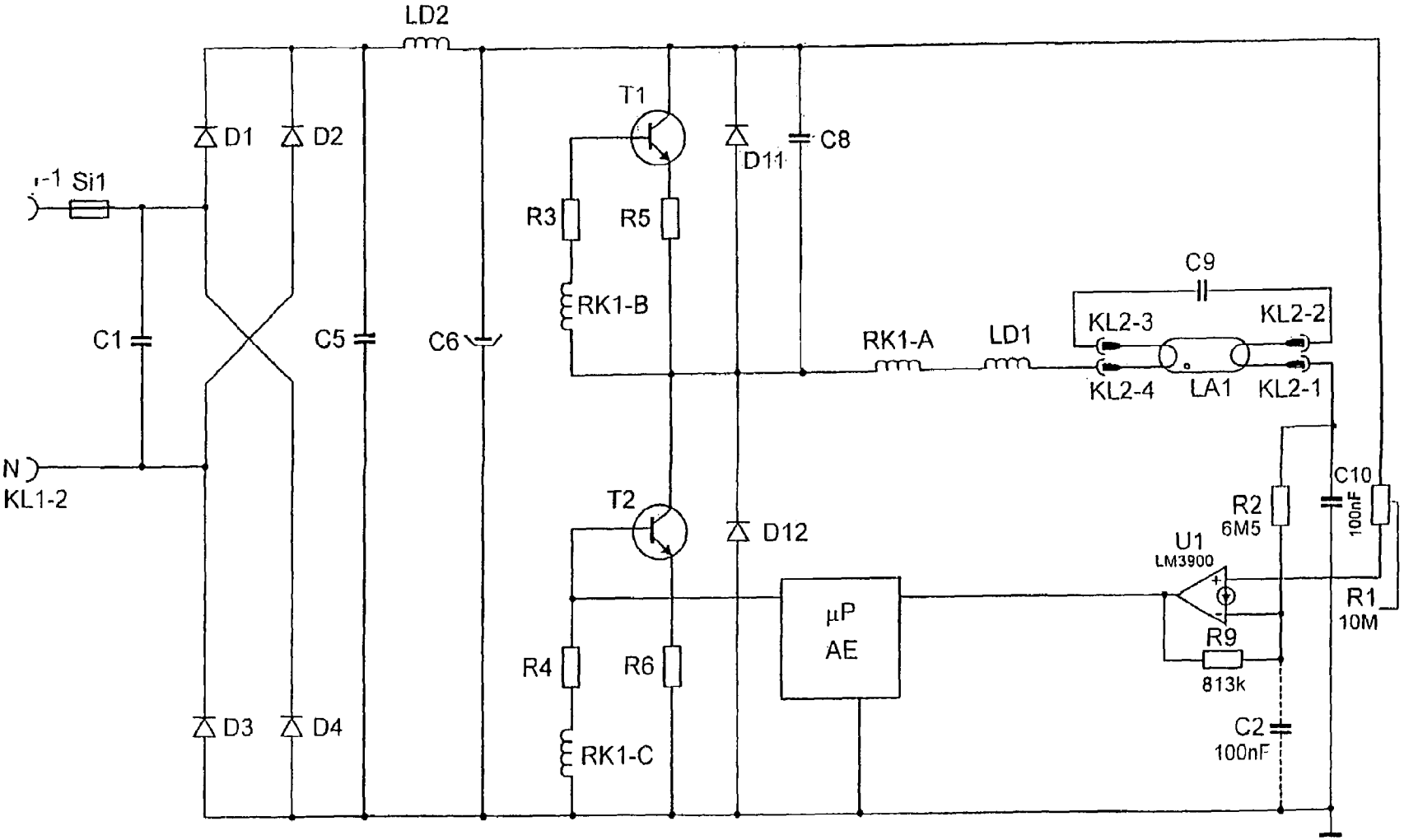
FIG. 3 corresponds to FIG. 1 and shows a third exemplary embodiment.

FIG. 3 largely corresponds to FIG. 1, with the result that reference is again made to the explanations relating to this figure. However, the window comparator U2-A, U2-B and the NAND gate U3-A are omitted between the amplifier U1 and the shutdown device AE. In this case, the shutdown device has a microprocessor μP, which samples the output of the amplifier U1 at specific time intervals and, in the case of output signals which are outside a predetermined window of in this case again 3.5 V to 8.5 V, carries out a repeat measurement for safety reasons and then introduces a shutdown operation. The invention can therefore also be combined with a microprocessor controller. In such applications, it is moreover naturally also possible for the switching transistors T1, T2 to be driven and for other functions of the ballast to be taken on with control by the microprocessor.

The invention claimed is:

1. An electronic ballast for the AC operation of a discharge lamp (LA1)

having an EOL monitoring circuit (R1, R2, U1, R9, U2-A, U2-B, U3-A, AE) for detecting the end of life of the electrodes of the discharge lamp (LA1), which EOL monitoring circuit (R1, R2, U1, R9, U2-A, U2-B, U3-A, AE) responds to an asymmetrical power of the discharge lamp (LA1), characterized in that a current associated with the asymmetrical power and a reference current are fed to a current differential amplifier (U1) in the EOL monitoring circuit (R1, R2, U1, R9, U2-A, U2-B, U3-A, AE).

2. The ballast as claimed in claim 1, in which the current differential amplifier (U1) has a current mirror circuit at the input.

3. The ballast as claimed in claim 1, in which the current differential amplifier (U1) has a voltage output.

4. The ballast as claimed in claim 1, in which an output signal line of the current differential amplifier (U1) is connected to a window comparator (U2-A, U2-B).

5. The ballast as claimed in claim 1, in which the EOL monitoring circuit (R1, R2, U1, R9, U2-A, U2-B, U3-A, AE) has a low-pass filter (R2, C2) for filtering out parasitic oscillations.

6. The ballast as claimed in claim 5, in which the low-pass filter (R2, C2) has a capacitor (C2) between a measured current input of the current differential amplifier (U1) and the internal reference potential of the ballast.

7. The ballast as claimed in claim 1, in which an output signal line of the current differential amplifier (U1) is connected to a microprocessor circuit (μP).

8. The ballast as claimed in claim 1, in which the reference current is derived from a reference potential via a resistor (R1).

9. The ballast as claimed in claim 8, in which the reference potential is the internal supply potential of a high-frequency converter (T1, T2) for generating the AC supply power for the discharge lamp (LA1).

10. The ballast as claimed in claim 1, in which a coupling capacitor (C10) is provided between the discharge lamp (LA1) and the internal reference potential of the ballast, the current differential amplifier (U1) has a reference to the reference potential, and the current associated with the asymmetrical power is derived from a tap between the coupling capacitor (C10) and the discharge lamp (LA1) via a resistor (R2).

11. The ballast as claimed in claim 1, in which a coupling capacitor (C10) is provided between the discharge lamp (LA1) and an AC output of a high-frequency converter (T1, T2) provided for generating the AC supply power for the discharge lamp (LA1), the current differential amplifier (U1) has a reference to the reference potential, and the current associated with the asymmetrical power is derived from a tap between the coupling capacitor (C10) and the discharge lamp (LA1) via a resistor (R2).

12. The ballast as claimed in claim 1, which is designed for a low-pressure discharge lamp (LA1).

13. A lamp system comprising a discharge lamp (LA1) and a ballast as claimed in claim 1.

14. The ballast as claimed in claim 2, in which the current differential amplifier (U1) has a voltage output.

15. The ballast as claimed in claim 2, in which an output signal line of the current differential amplifier (U1) is connected to a window comparator (U2-A, U2-B).

16. The ballast as claimed in claim 2, in which an output signal line of the current differential amplifier (U1) is connected to a microprocessor circuit (μP).

17. The ballast as claimed in claim 3, in which an output signal line of the current differential amplifier (U1) is connected to a microprocessor circuit (μP).

18. The ballast as claimed in claim 2, in which the reference current is derived from a reference potential via a resistor (R1).

19. The ballast as claimed in claim 2, in which a coupling capacitor (C10) is provided between the discharge lamp (LA1) and the internal reference potential of the ballast, the current differential amplifier (U1) has a reference to the reference potential, and the current associated with the asymmetrical power is derived from a tap between the coupling capacitor (C10) and the discharge lamp (LA1) via a resistor (R2).

20. The ballast as claimed in claim 2, in which a coupling capacitor (C10) is provided between the discharge lamp (LA1) and an AC output of a high-frequency converter (T1, T2) provided for generating the AC supply power for the discharge lamp (LA1), the current differential amplifier (U1) has a reference to the reference potential, and the current associated with the asymmetrical power is derived from a tap between the coupling capacitor (c10) and the discharge lamp (LA1) via a resistor (R2).

* * * * *